US010926296B2

(12) United States Patent
Moosmann

(10) Patent No.: US 10,926,296 B2
(45) Date of Patent: Feb. 23, 2021

(54) SCREEN DEVICE FOR UNLOADING SILO VEHICLES

(71) Applicant: BÜHLER AG, Uzwil (CH)

(72) Inventor: Jürgen Moosmann, Berg (DE)

(73) Assignee: BÜHLER AG, Uzwil (CH)

( * ) Notice: Subject to any disclaimer, the term of this patent is extended or adjusted under 35 U.S.C. 154(b) by 978 days.

(21) Appl. No.: 15/128,235

(22) PCT Filed: Apr. 1, 2015

(86) PCT No.: PCT/EP2015/057245
§ 371 (c)(1),
(2) Date: Sep. 22, 2016

(87) PCT Pub. No.: WO2015/150484
PCT Pub. Date: Oct. 8, 2015

(65) Prior Publication Data

US 2017/0106410 A1 Apr. 20, 2017

(30) Foreign Application Priority Data

Apr. 1, 2014 (EP) ..... 14162994

(51) Int. Cl.
*B07B 7/06* (2006.01)
*B07B 13/16* (2006.01)
*B07B 11/06* (2006.01)

(52) U.S. Cl.
CPC ..... *B07B 7/06* (2013.01); *B07B 11/06* (2013.01); *B07B 13/16* (2013.01)

(58) Field of Classification Search
CPC ..... B07C 5/3416
(Continued)

(56) References Cited

U.S. PATENT DOCUMENTS 2,219,453 A 10/1940 Mosley
4,465,420 A * 8/1984 Dillman ..... B60P 1/04 414/332

(Continued)

FOREIGN PATENT DOCUMENTS

DE 34 43 182 A1 6/1986
EP 1 344 576 A1 9/2003

(Continued)

OTHER PUBLICATIONS

Machine Translation of DE3443182A1.*

(Continued)

*Primary Examiner* — Charles A Fox
*Assistant Examiner* — Michael E Butler
(74) *Attorney, Agent, or Firm* — Davis & Bujold PLLC; Michael J. Bujold

(57) ABSTRACT

A passive food screen device (1) for flour in a delivery flow comprising: a housing (2) with a housing inlet (3) and a housing outlet (4); a closed screen insert (5) arranged substantially within the housing (2) such that a spatial area (6) is formed between the inner wall (7) of the housing (2) and the outer wall (8) of the screen insert (5) and screen elements (9) of the screen insert (5) are arranged substantially parallel to the main conveying direction (F); and a hose coupling (10) on the housing inlet (3) and/or on the housing outlet (4). The food screen device allows a high delivery capacity, and, by virtue of its narrow design, can be carried on a silo vehicle and used as a control screen when delivering flour. The food screen device (1) is designed such that the flour can be moved in an air delivery stream.

19 Claims, 9 Drawing Sheets

Figure 1A:
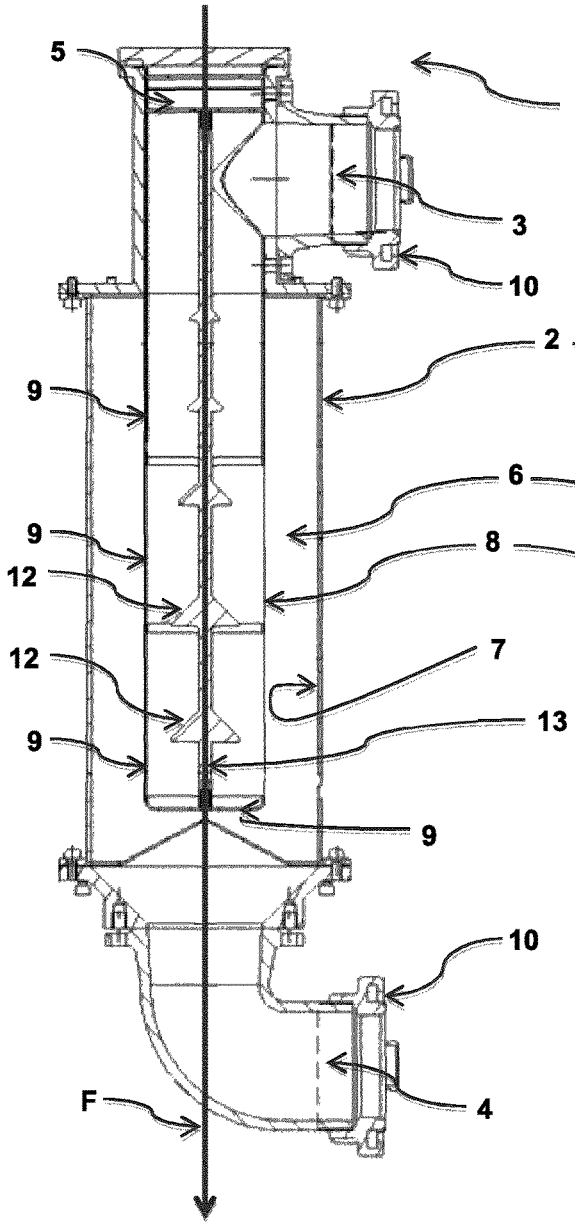

(58) Field of Classification Search
USPC ..... 209/582
See application file for complete search history.

(56) References Cited

U.S. PATENT DOCUMENTS

| | | | | |
|---|---|---|---|---|
| 4,897,094 | A * | 1/1990 | Maeda | B01D 46/0012 96/409 |
| 5,427,250 | A | 6/1995 | Page et al. | |
| 5,791,727 | A * | 8/1998 | Doescher | B60J 1/14 296/146.16 |
| 2005/0142279 | A1* | 6/2005 | Schill | A23J 1/04 426/656 |
| 2011/0262612 | A1* | 10/2011 | Gotz | A21D 2/38 426/583 |
| 2012/0219391 | A1* | 8/2012 | Teichrob | B65G 63/008 414/293 |
| 2017/0050129 | A1* | 2/2017 | Kozey | B01D 35/05 |

FOREIGN PATENT DOCUMENTS

| | | |
|---|---|---|
| FR | 944 763 | 4/1949 |
| GB | 1 414 882 | 11/1975 |
| WO | 87/00454 A1 | 1/1987 |
| WO | 91/05616 A1 | 5/1991 |

OTHER PUBLICATIONS

International Search Report Corresponding to PCT/EP2015/057245 dated Jun. 16, 2015.
Written Opinion Corresponding to PCT/EP2015/057245 dated Jun. 16, 2015.

* cited by examiner

SCREEN DEVICE FOR UNLOADING SILO VEHICLES

The invention relates to the technical field of milling, in particular to screening flour when unloading silo vehicles.

In mills nowadays it is already ensured at great expense and in a very reliable manner that the flour is free in particular of particulate contaminants. The flour is subsequently transported by silo vehicles to the further processor (a bakery, for example). While the standards of hygiene in silo vehicles may typically not give rise to complaints, particulate contaminants such as small rocks, for example, are indeed occasionally found. In principle, it is in the interest of the further processor that particulate contaminants, in particular, such as condensed lumps of flour, bristle remnants from brushes, occasionally even small rocks or the like, do not find their way into their silo. Therefore, during unloading so-called control screens are often disposed in the pneumatic conveying path between the silo vehicle and the silo of the further processor. Control screens of this type are located on-site at the further processor, since the former are practically incapable of being conjointly carried on the silo vehicle. Control screens according to various operating principles are known in principle. Herein, there is always the requirement for the flow velocity and thus the unloading time to not be influenced as far as possible. One generic type of passive control screens ensures this substantially by way of as large a screen area as possible, which is disposed so as to be transverse to the main conveying direction. Devices of this type are very demanding in terms of space. Other known control screens such as vibrating screen machines, for example, may indeed be conceived to be more space saving but do require additional energy.

A control screen in which additional air, ahead of a screen which is disposed so as to be transverse to the main conveying direction, is blown in so as to be parallel with the conveying flow per se, is known from GB 1 414 882. This additional air is fed from the same compressed-air source as the conveying air for the conveying flow; there is thus no requirement for additional energy. However, the filter performance and the reliability of such a device are not sufficient in many cases. Moreover, the installation size is excessive for many needs, and the construction having a separate bypass line for the additional air is complex.

Document FR 944 763 discloses a classification device in which the product is infed by way of a port, is deflected by a parabolic deflector, and is subsequently by means of further deflectors directed through two cylindrical metal meshes. The finer fraction leaves the device by way of two ports in the lower region, while the coarser fraction exits by way of a horizontal port. This classification device thus subdivides the particle flow into two separate particle flows.

Screen devices having a cylindrical screen are known from U.S. Pat. No. 2,219,453. A member which widens in the manner of a truncated cone is disposed within this screen. Here too, a particle flow is subdivided into two separate particle flows.

It is thus an object of the present invention to avoid the disadvantages of the prior art, in particular to provide a foodstuff screen device for flour in a conveying flow that may be operated without a dedicated and separate energy supply, is simple to manage, and guarantees a high conveying performance.

This object is achieved by the subject matter of the independent patent claims. Advantageous design embodiments are stated in the dependent patent claims.

A first aspect of the present invention relates to a passive foodstuff screen device for flour in a conveying flow, comprising

- a housing having a housing inlet and a housing outlet;
- a closed screen insert which is disposed so as to be substantially within the housing in such a manner that
  - i. a spatial region is formed between the internal wall of the housing and the external wall of the screen insert;
  - ii. screen elements of the screen insert are disposed so as to be substantially parallel with the main conveying direction;
- a hose coupling on the housing inlet and/or on the housing outlet;

wherein the foodstuff screen device is configured in such a manner that the flour is capable of being driven in a conveying flow of air.

The screen device according to the invention is configured as a passive screen device. Said screen device thus does not contain any actively driven components such as is the case in the devices disclosed in EP 1 344 576 A1, WO 91/05616 A1, and U.S. Pat. No. 5,427,250, for example. By dispensing with actively driven components the screen device is particularly low in maintenance.

Foodstuffs which are screened by the foodstuff screen device according to the invention are bulk products. These here are typically cereals, comminuted cereal products, and cereal end products from milling (in particular from soft wheat, durum, rye, corn, and/or barley) or from special milling (husked products or comminuted products of soy, buckwheat, barley, spelt, millet/sorghum, pseudo cereals, and/or pulses); or else feedstuffs for productive livestock or domestic pets, fish, and crustaceans; oil seed and processed products thereof; malted and shot-grain products; sugar, salt, cocoa beans, nuts, and coffee beans, and processed products thereof.

The bulk product which is preferably flour is introduced into the screen device by way of the housing inlet. This is performed pneumatically in a manner known per se. The bulk product leaves the screen device again by way of the housing outlet. A closed screen insert which is located substantially within the housing is disposed between the housing inlet and the housing outlet. Parts of the screen insert that do not serve screening per se, may herein also be disposed outside the housing. This may be expedient, for example, in order to ensure retrievability of the screen insert in a particularly simple manner in that part of the screen insert protrudes toward the outside or extends at least up to the external region of the screen device, and in this way, for cleaning purposes for example, is readily retrievable following corresponding unlocking, for example. The screen insert according to the invention is disposed in the housing in such a manner that a spatial region is formed between the internal wall of the housing and the external wall of the screen insert (said external wall being at least partially formed by screen elements). The bulk product, after having passed the screen element(s), enters this spatial region.

The screen insert is configured as a closed screen insert (as opposed to the screens disclosed in WO 87/00454 A1, FR 944 763, WO 91/05616 A1, or U.S. Pat. No. 2,219,453, for example). Herein and hereunder, this is understood to mean that the screen insert has an inlet for the flour and contaminants potentially contained in the latter, but does not have an outlet for contaminants which have been retained by the screen insert. A closed screen insert in the context of the invention is also understood in particular to be a screen insert as described hereunder, which in the base region has screen areas through which only the flour but not the contaminants may exit.

The screen elements are disposed so as to be substantially parallel with the main conveying direction.

"Main conveying direction" in the context of the invention is in particular understood to be the longitudinal axis of the housing.

"Substantially parallel" in the context of the invention is also understood to comprise a deviation of ±45°. However, the deviation is advantageously less than ±20°, particularly advantageously less than ±15°.

Furthermore, the screen device according to the invention is configured in such a manner that the flour is capable of being driven in a conveying flow of air. The flour thus does not drop only by virtue of the force of gravity thereof, as is the case, for example, of the screened product treated according to WO 87/00454 A1 or U.S. Pat. No. 5,427,250. Particularly preferably, the flour is driven in a conveying flow of compressed air. On account thereof, the throughput may be significantly increased. On account thereof, the screen device according to the invention may also fulfill the function thereof at any orientation, that is to say independently of the force of gravity.

The screen area that is formed by the entirety of the screen elements particularly advantageously to at least 80%, advantageously to at least 90%, particularly advantageously to at least 95% is aligned so as to be substantially parallel with the main conveying direction.

On account of the fact that the screen element(s) is/are largely disposed so as to be substantially parallel with the main conveying direction, a very high screen performance may be achieved at as little space requirement as possible, and the flow velocity may be left to not be substantially influenced, as hoses and pipelines are in any case connected when unloading a silo vehicle, so as to establish a fluid connection. A screen device according to the invention may be simply incorporated in this fluid connection. This is performed by way of hose couplings which are known per se, which are provided on the housing inlet, on the housing outlet, or both on the housing inlet as well as on the housing outlet. Both silo vehicles as well as connector devices on silos are in any case already equipped with hose couplings of this type. Screen devices according to the invention may thus be very simply incorporated in a fluid connection between a silo vehicle and a silo. Preferable hose couplings in the context of the invention are plug-type couplings and those screw-type couplings which are capable of being fixed with as few rotations as possible, in particular with fewer than one complete rotation. Hose couplings that are very particularly preferably employable in the context of the invention are firefighting couplings such as the so-called Storz couplings, for example, which function on the principle of a bayonet closure. Herein, dogs of the one coupling half engage in corresponding contours of the counter coupling and latch therein by twisting the two coupling halves. Particularly preferably, the hose couplings are configured from aluminum, in particular from forged or pressed aluminum. However, hose couplings from brass, gunmetal, or stainless steel are likewise possible. Sealing materials for employment in such hose couplings, polyurethane or polytetrafluorethylene for example, are known in foodstuffs technology.

A screen device according to the invention may be connected to a complementary fixed coupling which exists on the silo, for example, or directly to the outlet of the silo vehicle, or else between two elements of the fluid connection which is to be established by means of hose elements and/or pipe elements between a silo vehicle and a silo.

It has been found that typical unloading performances of 30 t/h (at a pneumatic pressure of approx. 1.5 to 2.0 bar) are attainable now as then, using screen devices according to the invention. Nevertheless, screen devices according to the invention with a weight of below 25 kg may be readily implemented, since no separately driven parts such as, for example, vibrating bases or the like are contained.

The screen device may have a construction length in the range from 5 cm to 1 m, preferably from 7.5 cm to 60 cm. The internal wall of the housing may have a diameter (or another comparable average dimension, for example a lateral width in the case of square embodiments) that is in the range from 11 cm to 35 cm, preferably from 13 cm to 25 cm, particularly preferably from 15 cm to 20 cm. The annular width of an annular space/annular region may be in the range from 10 mm to 50 mm. The internal diameter of the screen insert may be in the range from 10 cm to 30 cm, preferably in the range from 13 cm to 17 cm.

Screen devices according to the invention may thus also be constructed to be very narrow, because discharging of the screened rejects may be dispensed with. Only (very) small amounts of contaminants are typically contained in this stage of the production chain. Contaminants that are retained by the screen device may thus be periodically disposed of in a simple manner by retrieving and emptying the screen insert.

The mesh size of the screen elements is typically 3 mm or less, in particular between 1 mm and 3 mm, or between 1.5 mm and 2.5 mm.

In preferred embodiments of the screen device the spatial region between the internal wall of the housing and the external wall of the screen insert is configured so as to be substantially cylinder-barrel shaped, cone-shell shaped, or truncated cone-shell shaped. Geometries of this type enable particularly narrow construction modes and guarantee ready retrievability of the screen insert, as will be explained hereunder.

Furthermore preferably, external installations for flow direction are disposed in the spatial region between the internal wall of the housing and the external wall of the screen insert. Installations of this type support the conveying performance, prevent deposits, and in particularly advantageous design embodiments provide turbulences which prevent the accumulation of bulk product ahead of the screen. Such external installations are very particularly preferably helically configured, either as a single helix or else as non-interconnected helical elements. Furthermore preferably, helical external installations of this type are configured in such a manner that the helix or the helical elements continue through the entire spatial region at least once.

It has likewise been demonstrated to be particularly advantageous for one or a plurality of internal installations for flow direction to be disposed within the screen insert. On account thereof, a flow that is of such turbulence that build-ups of bulk product ahead of the screen elements may be reliably prevented may be achieved already before the bulk product passes through the screen element(s). Internal installations of this type are advantageously disposed in a substantially cone-shaped or truncated cone-shaped manner on an axle along the main conveying direction, wherein shell surfaces of the installation(s) are aligned in the main conveying direction in such a manner that said shell surfaces cause deflection in the direction of the screen elements. In the case of a plurality of installations of this type being provided along the main conveying direction, said installations are preferably configured in such a manner that the base area thereof is larger the farther downstream said installations are disposed.

It has been demonstrated to be furthermore advantageous that at least one further internal installation, in particular a helical installation, is disposed upstream of the cone-shaped or truncated cone-shaped internal installation(s) as described above. This further internal installation, in particular the helical installation, is preferably disposed within the screen insert. Particularly advantageously, a cone-shaped internal installation that extends up to the downstream end of the screen insert is provided, wherein the further and in particular helical internal installation upstream is configured so as to reach up to the cone-shaped internal installation.

Such screen devices that, upstream of the cone-shaped or truncated cone-shaped internal installation(s), have at least one further internal installation which

- in the upstream end region thereof is configured so as to be cone-shaped, wherein a cone tip of the internal installation(s) points upstream; and
- in the downstream region thereof is configured so as to be cone-shaped or truncated cone-shaped, wherein a cone tip of the installation(s) that is/are configured in the downstream region so as to be cone-shaped, or a cover area of the installation(s) that is/are configured in the downstream region so as to be truncated cone-shaped, respectively, points downstream have also proven advantageous.

Deflection of the bulk product is caused by way of the cone tip that is provided in the upstream end region and that points upstream, without deposits being able to be created. The turbulences associated therewith effectively prevent the deposition of the bulk product ahead of the screen elements. The installation in the downstream region thereof, by way of the cone tip or the cover area, respectively, is directed downstream, on account of which the flow may again be collected to form a smaller cross section.

It has proven advantageous in some embodiments that an internal installation is configured so as to be substantially cone-shaped, reaching down into the downstream end region of the screen insert, wherein the diameter of the base area of the cone-shaped internal installation on the downstream end region of the screen insert corresponds substantially to the diameter of the screen insert. The cone-shaped internal installation herein may extend substantially across the entire length of the screen insert.

Screen devices according to the invention do not require any further supply of energy (apart from the flow energy of the pneumatic conveying flow), in order for screening to be effected. However, movably mounted elements which are capable of being set in motion by the bulk product flowing through the screen device may be employed in the context of the invention. This herein is particularly preferably a rotary motion. In principle, all installations as described above may be movably mounted in such a manner that said installations are capable of being set in motion, in particular in rotation, by virtue of a conveying flow. To this end, helical installations in the surface structure thereof do not require any further modification; surface structures which are suitable for achieving a torque (helical ribs, or similar, for example) are to be provided only in the case of the described cone-shaped or truncated cone-shaped installations.

As has already been described above, the screen insert is particularly advantageously retrievable from the housing. Cleaning is significantly facilitated as a result. Furthermore preferably, the housing to this end, in particular in the region of the housing inlet, has a lockable cover, in particular a removable cover or a flap or pivot cover, which enables the housing to be opened in such a manner that the screen insert is retrievable from the housing. On account thereof, erroneous manipulations during operation that could lead to inadvertent separation of the screen insert from the housing are substantially precluded, while nevertheless maintaining very simple handling.

It has proven to be particularly advantageous that a screen device according to the invention does not substantially require a downstream base region which is disposed so as to be substantially orthogonal to the main conveying direction and is not equipped with screen elements. It has been established that a closed base region can be dispensed with for generating turbulences that are sufficient for preventing an accumulation of bulk product ahead of the screen elements. Rather, this base region in a particularly advantageous manner is also available for being equipped with screen elements. The majority of the screen area is however formed so as to be substantially parallel with the main flow direction, as has been explained above.

In advantageous embodiments, the housing inlet may be disposed in a tangential manner. This causes direct deflection of the flow, on account of which an advantageous turbulence may be generated already at a short distance from the housing inlet, even before the bulk product reaches the screen elements.

The housing advantageously has at least one viewing window through which the flour flowing through the screen insert is visible. In this manner, the correct functioning of the screen device may be checked, and it may in particular be established when the screen insert is to be cleaned or replaced.

One further aspect of the invention relates to the use of a foodstuff screen device as described above, as a screen device which is capable of being conjointly carried on a silo vehicle. By virtue of the narrow construction mode, the screen device may readily be conjointly carried by a silo vehicle, as is otherwise also usual for hose elements. It is thus no longer necessary for a further processor to have available a control screen at the unloading site. The screen device according to the invention herein may either be stored like usual hose elements in stowage compartments on the vehicle. For use, the screen device is then retrieved from a stowage compartment and incorporated in the fluid connection from the silo vehicle to the silo. Alternatively, it is likewise possible for the screen device to be fixedly installed on the silo vehicle. By virtue of the minor construction length of typically less than approx. 1 m, this may be performed in the rearward region of a silo vehicle, transversely to the direction of travel, for example. Depending on requirements, the screen device according to the invention may then be put in fluid connection on the entry side by way of hose elements with the outlet of the silo vehicle, and on the exit side with the silo.

One further aspect of the invention accordingly relates to a silo vehicle equipped with a foodstuff screen device as has been described above.

One last aspect of the invention relates to a method for unloading a silo vehicle, the method comprising the following steps:

- establishing a fluid connection between an outlet of the silo vehicle and the inlet of a silo in such a manner that the fluid connection comprises a screen device as has been described above; and
- pneumatically conveying the payload from the silo vehicle through the screen device into the silo.

Pneumatic conveying is preferably performed by means of compressed air, since the throughput may be significantly increased on account thereof.

Figure 1B:
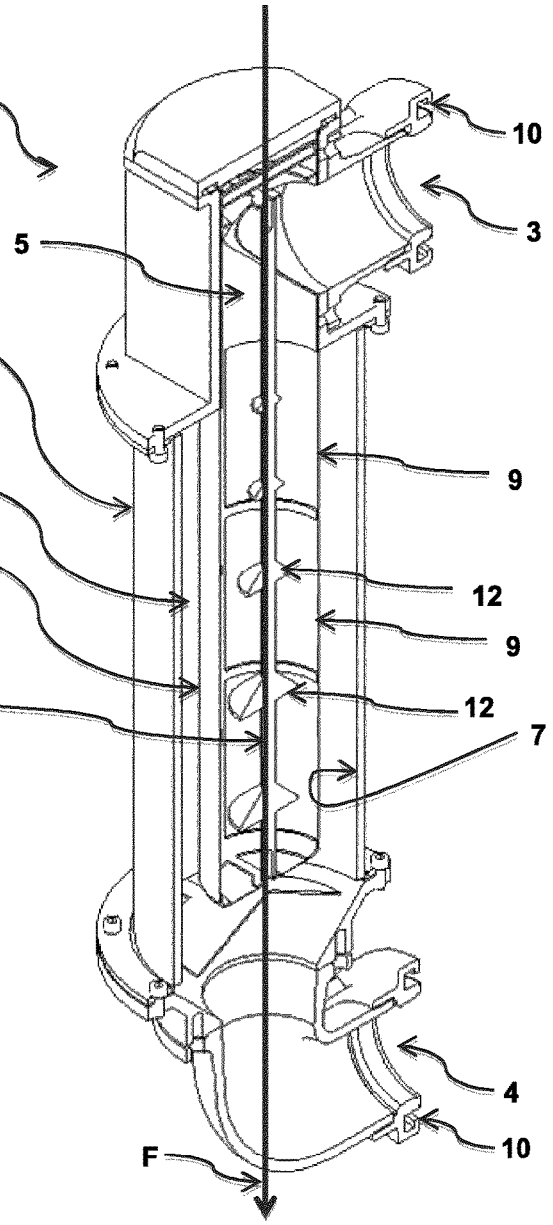
Figure 1C:
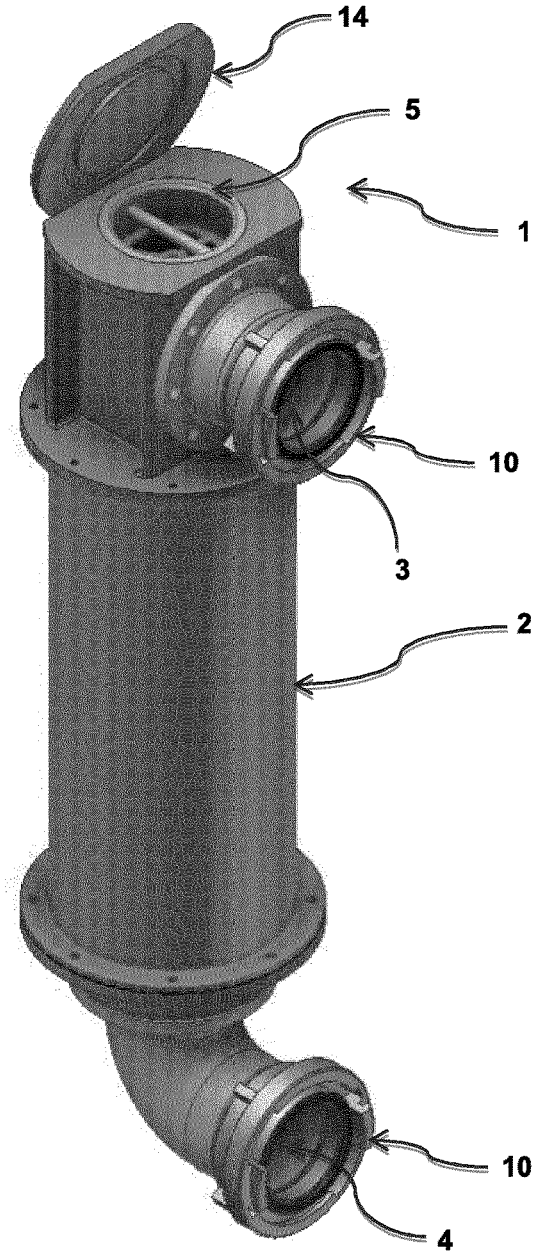
Figure 1D:
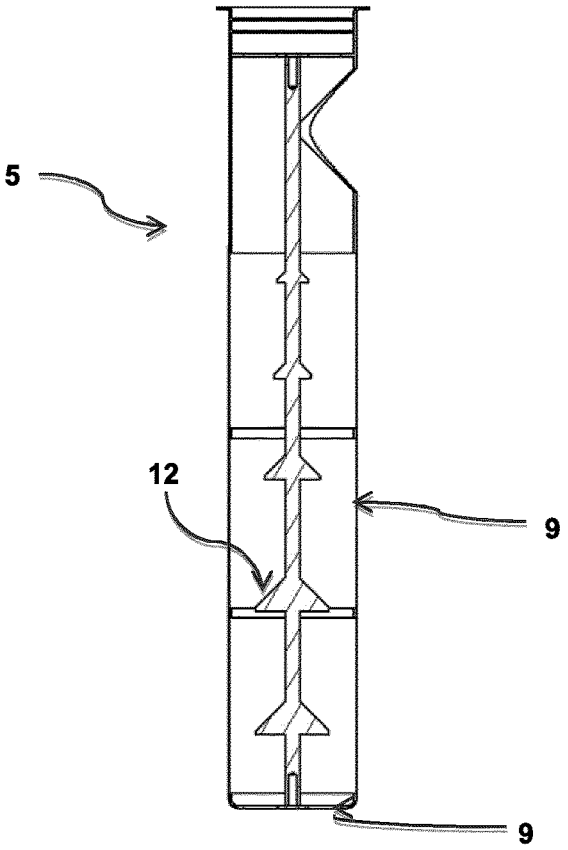
Figure 2A:
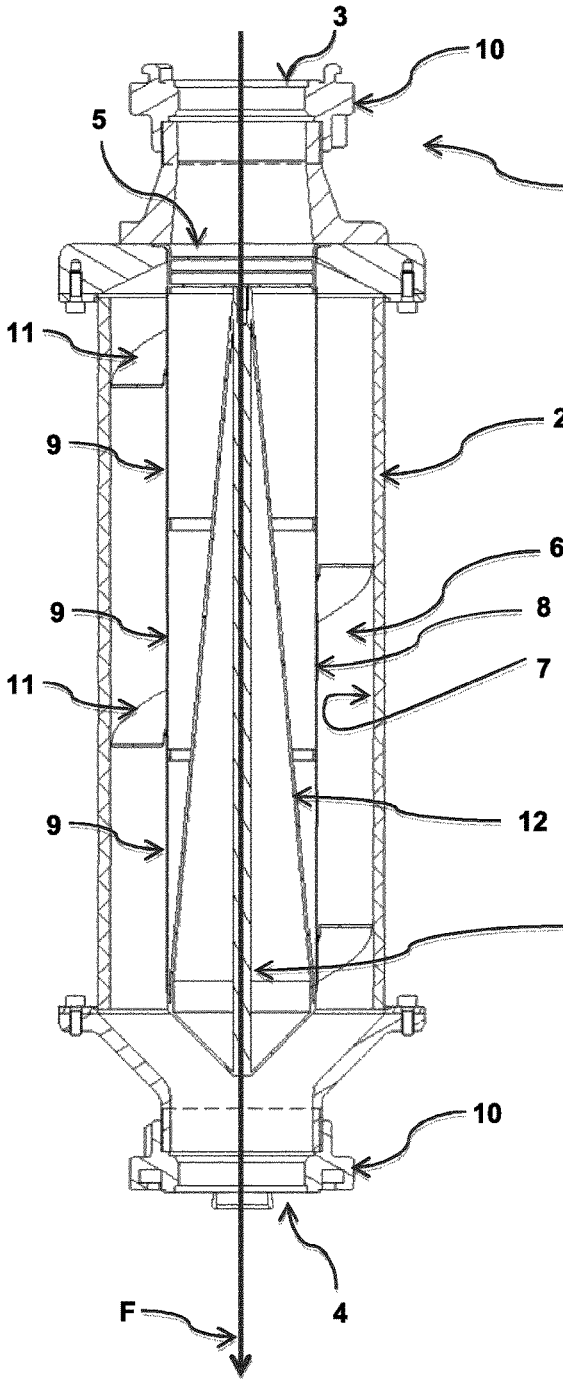
Figure 2B:
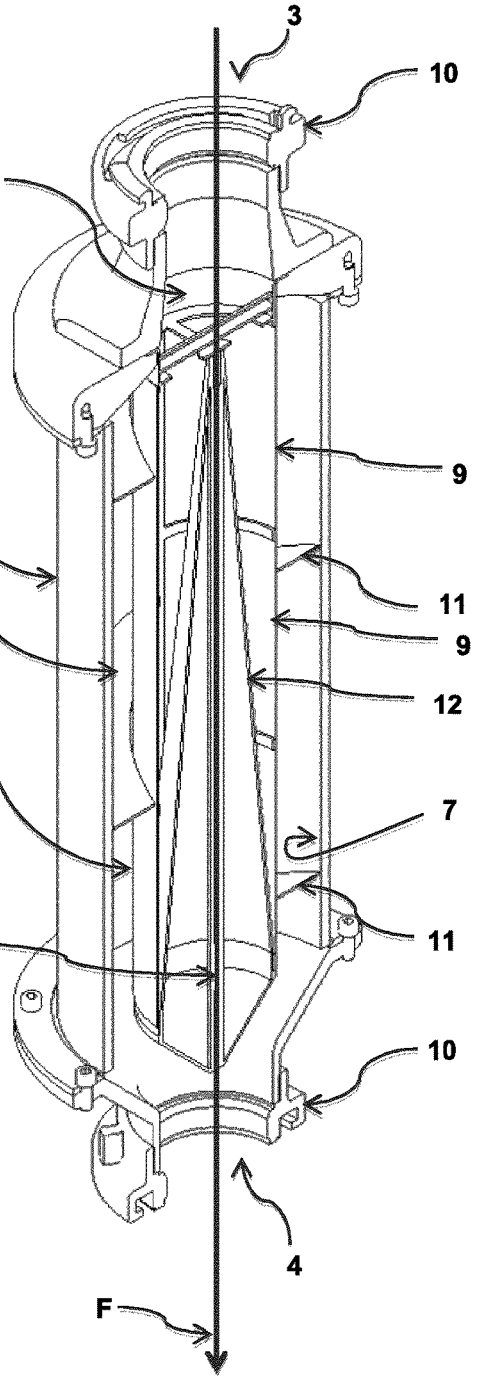
Figure 2C:
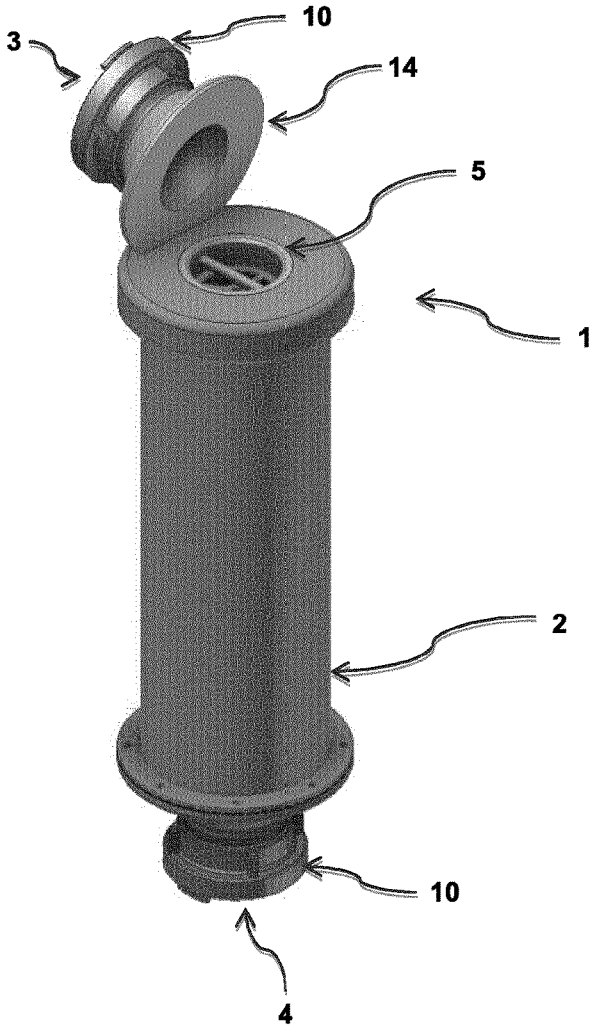
Figure 2D:
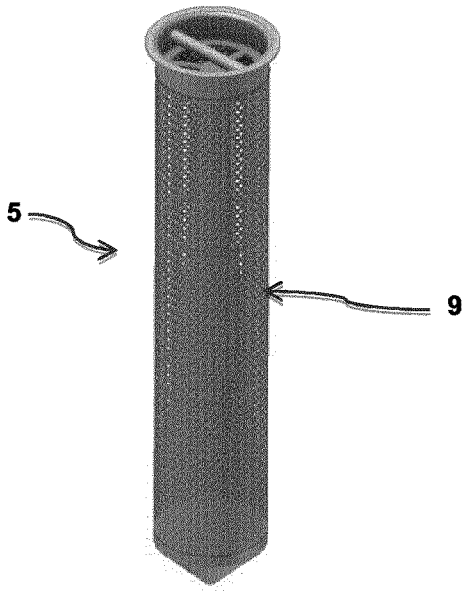
Figure 3A:
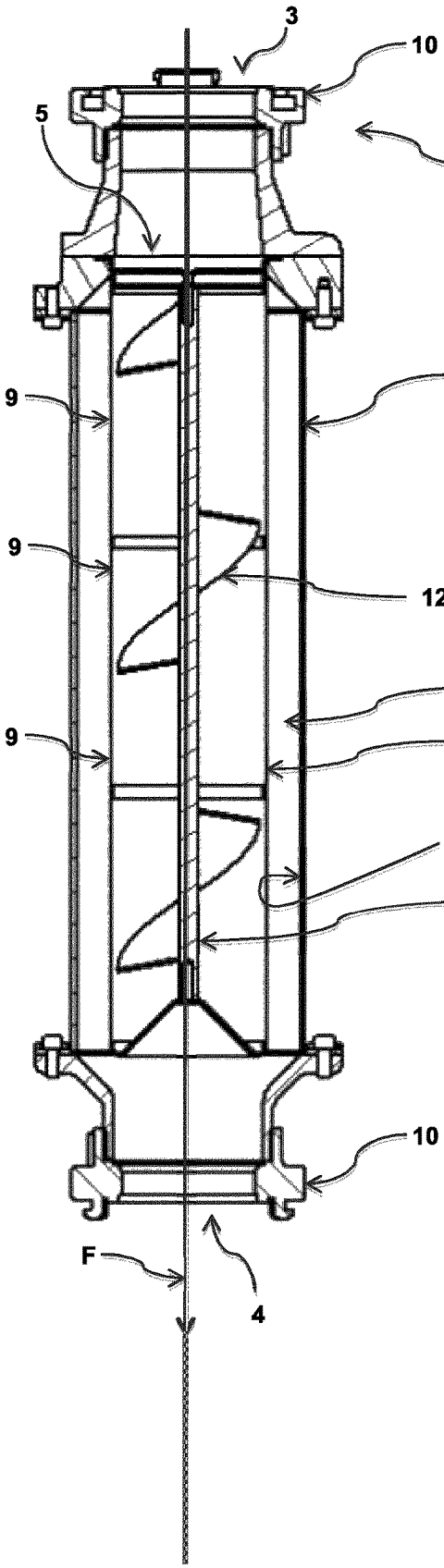
Figure 3B:
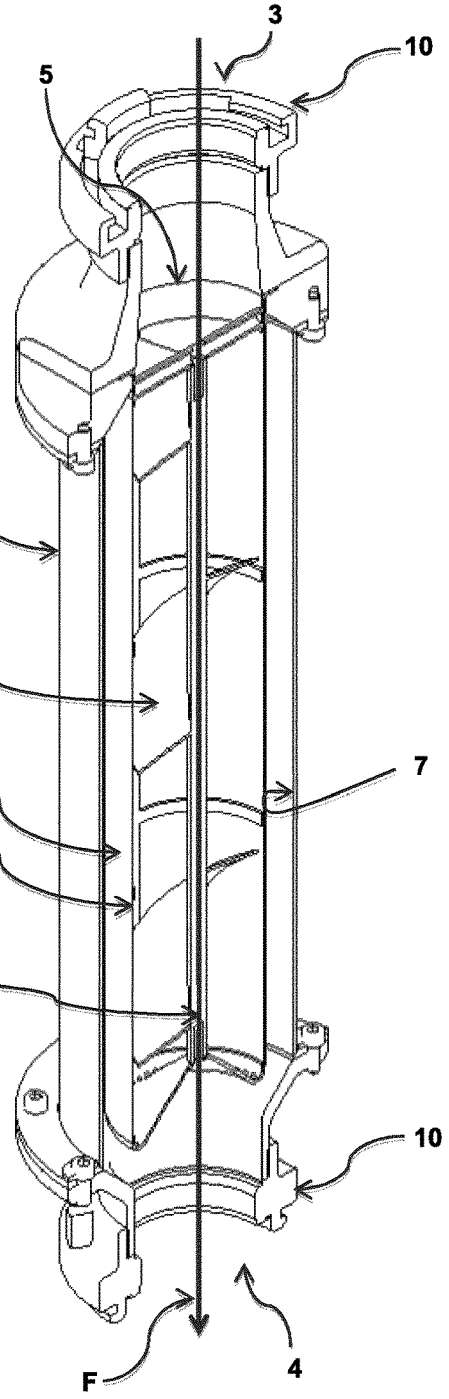
Figure 3C:
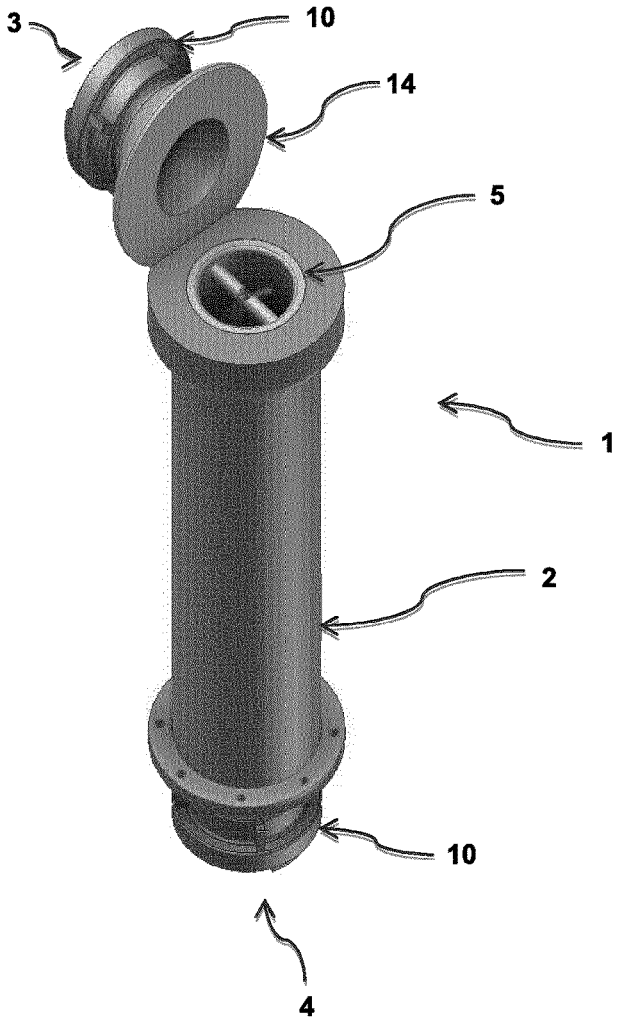
Figure 3D:
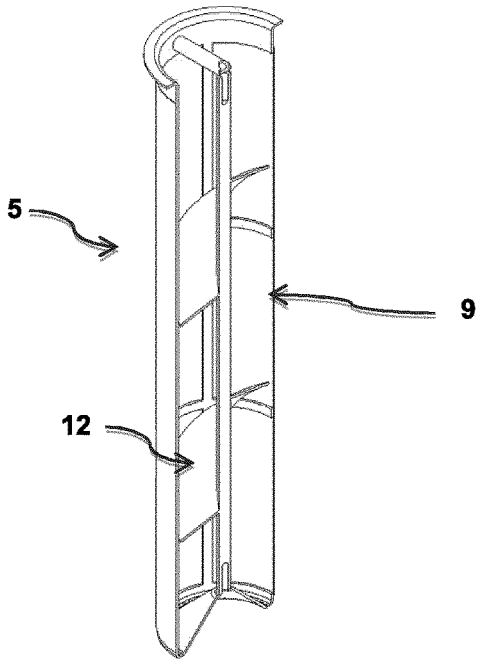
Figure 4A:
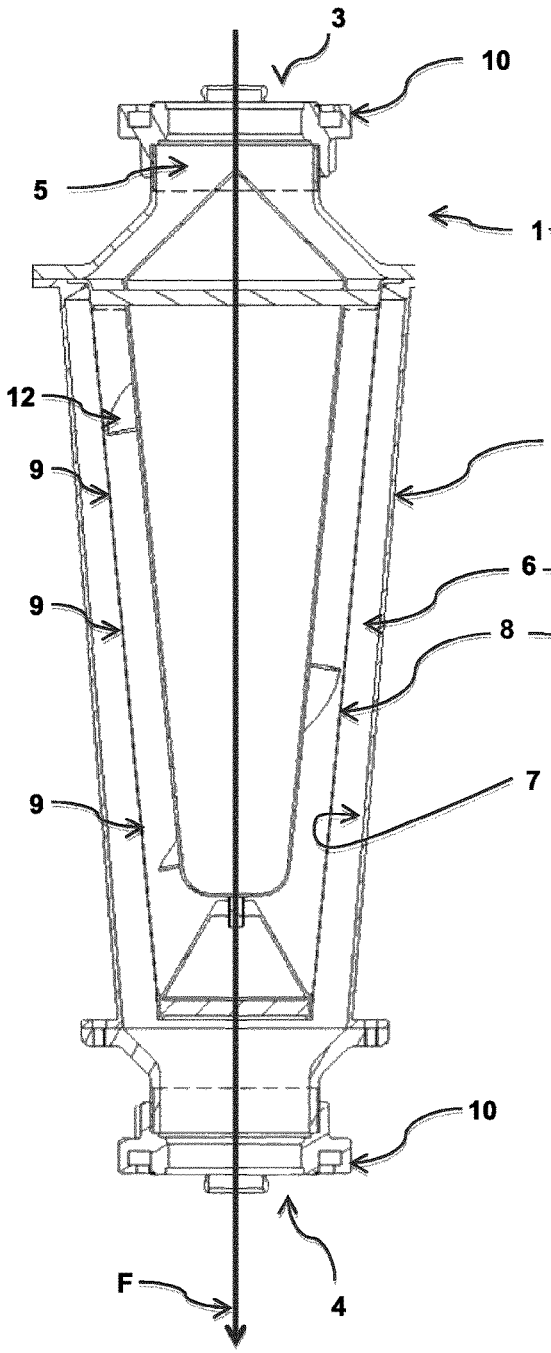
Figure 4B:
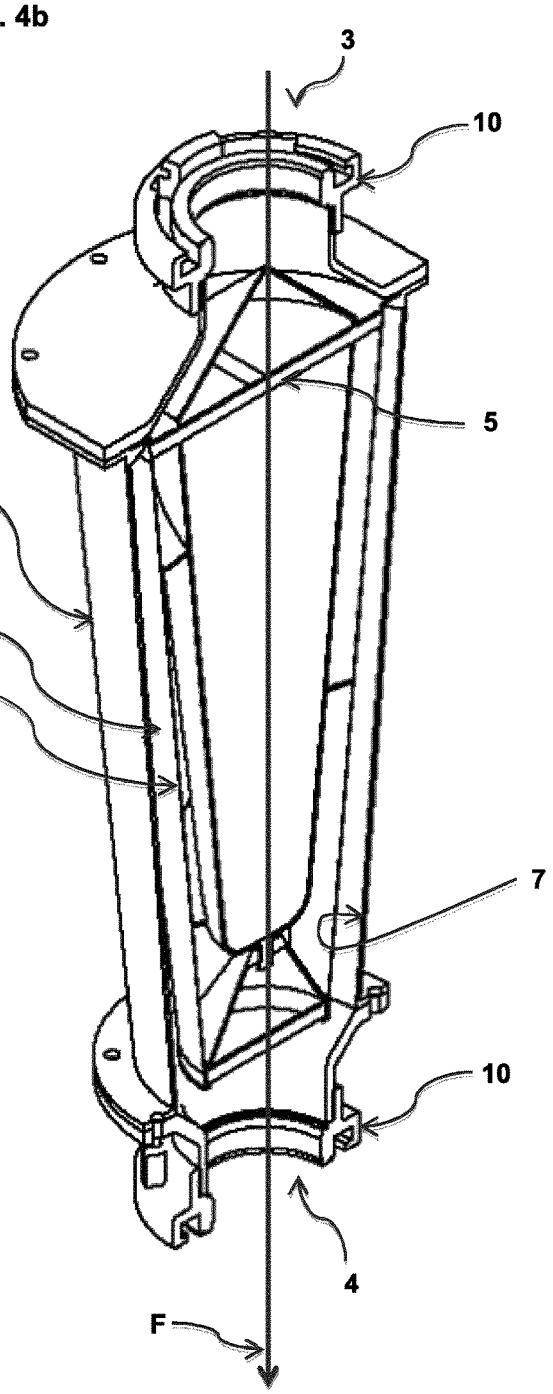
Figure 4C:
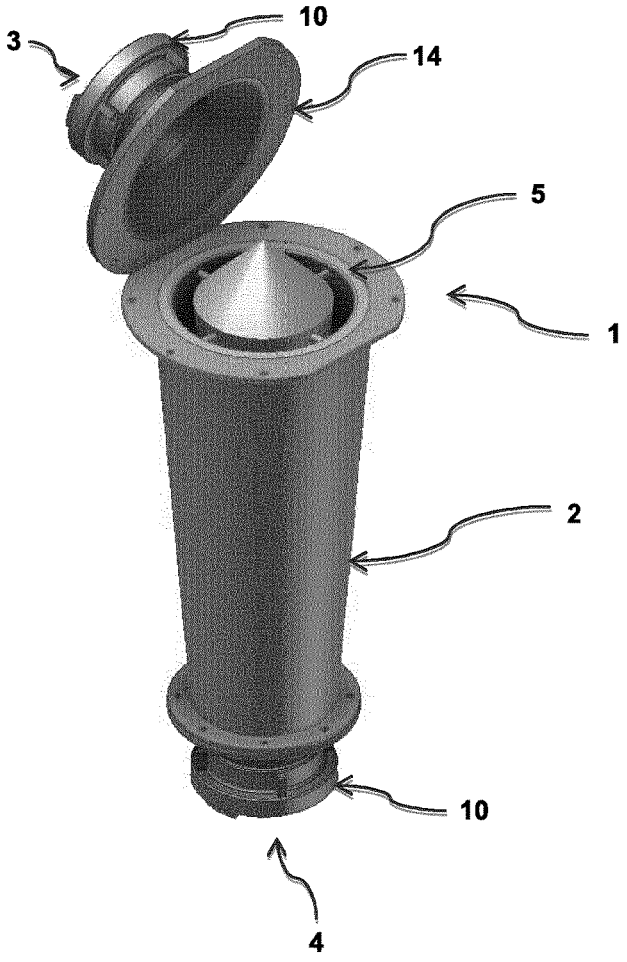
Figure 4D:
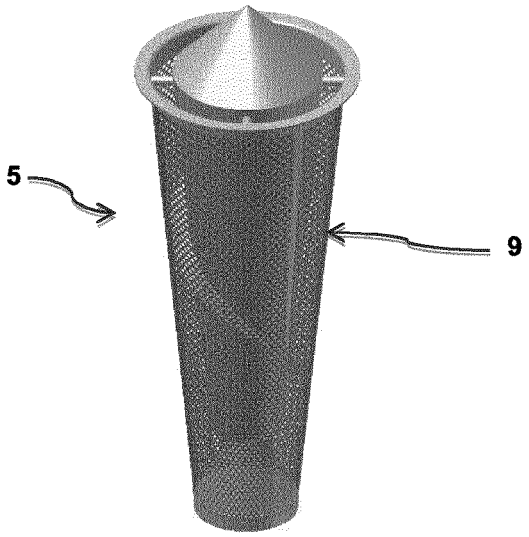
Figure 5A:
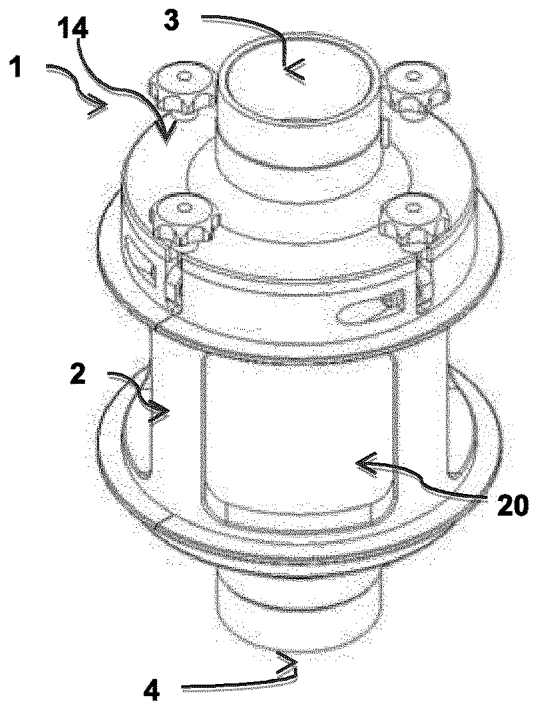
Figure 5B:
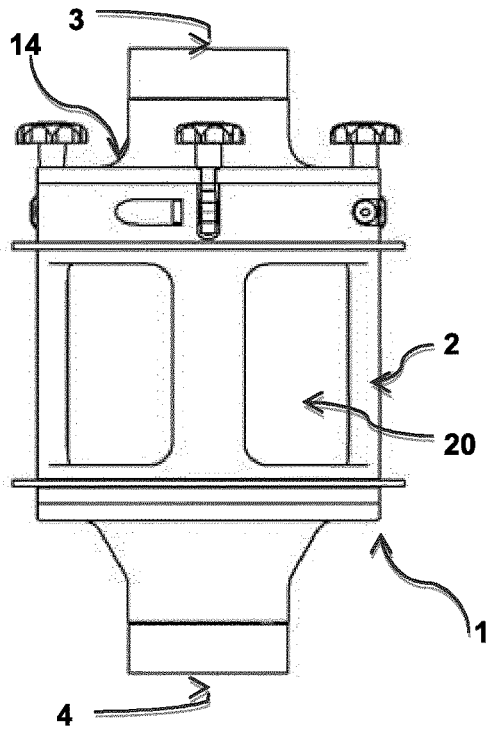
Figure 5C:
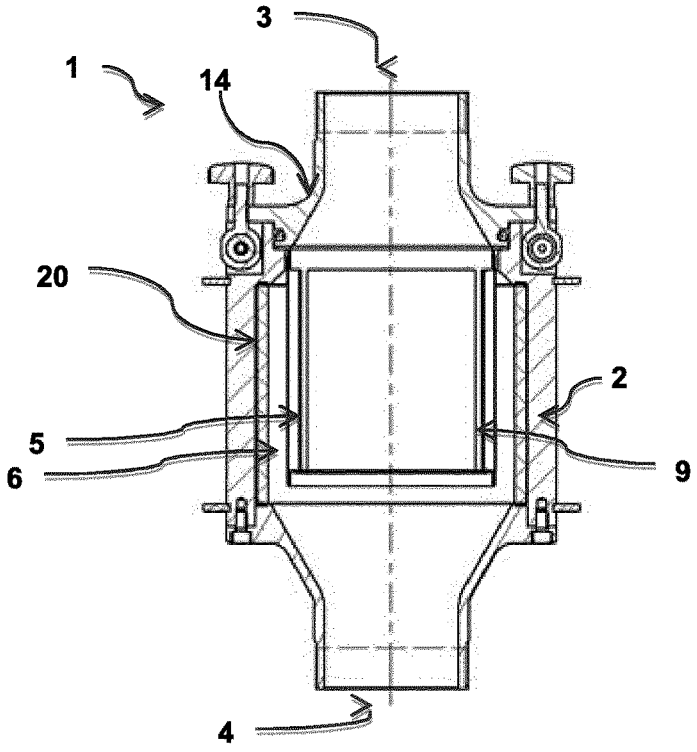

The invention will be explained in more detail hereunder by means of exemplary embodiments and figures, without limiting the subject matter of the invention to the embodiments shown. In the figures:

FIG. 1*a* shows a schematic illustration of a first embodiment according to the invention of a screen device in the cross section;

FIG. 1*b* shows a three-dimensional sectional drawing of the first embodiment according to the invention of a screen device;

FIG. 1*c* shows a three-dimensional overall view of the first embodiment according to the invention of a screen device;

FIG. 1*d* shows a cross section of the screen insert of the first embodiment according to the invention of a screen device;

FIG. 2*a* shows a schematic illustration of a second embodiment according to the invention of a screen device in the cross section;

FIG. 2*b* shows a three-dimensional sectional drawing of the second embodiment according to the invention of a screen device;

FIG. 2*c* shows a three-dimensional overall view of the second embodiment according to the invention of a screen device;

FIG. 2*d* shows a three-dimensional overall view of the screen insert of the second embodiment according to the invention of a screen device;

FIG. 3*a* shows a schematic illustration of a third embodiment according to the invention of a screen device in the cross section;

FIG. 3*b* shows a three-dimensional sectional drawing of the third embodiment according to the invention of a screen device;

FIG. 3*c* shows a three-dimensional overall view of the third embodiment according to the invention of a screen device;

FIG. 3*d* shows a cross section of the screen insert of the third embodiment according to the invention of a screen device;

FIG. 4*a* shows a schematic illustration of a fourth embodiment according to the invention of a screen device in the cross section;

FIG. 4*b* shows a three-dimensional sectional drawing of the fourth embodiment according to the invention of a screen device;

FIG. 4*c* shows a three-dimensional overall view of the fourth embodiment according to the invention of a screen device;

FIG. 4*d* shows a three-dimensional overall view of the screen insert of the fourth embodiment according to the invention of a screen device;

FIG. 5*a* shows a fifth embodiment according to the invention of a screen device in a perspective view;

FIG. 5*b* shows the fifth embodiment according to the invention in a side view;

FIG. 5*c* shows the fifth embodiment according to the invention in a lateral sectional view.

FIGS. 1*a/b* show a first embodiment according to the invention of a screen device 1 in the cross section (FIG. 1*a*) and in a three-dimensional sectional drawing (FIG. 1*b*), respectively. The screen device 1 has a housing 2 which is configured so as to be substantially cylindrical. A tangential housing inlet 3 is disposed in the upstream end region of the housing 2; a housing outlet 4 is disposed in the downstream end region of the housing 2. The housing 2 in this first embodiment has end pieces in which housing inlet 3 and housing outlet 4 are provided, wherein these end pieces are fitted by screw connections. Moreover, the screen device has a screen insert 5 which has screen elements 9. A spatial region 6 for the screen passage is formed between the internal wall 7 of the housing 2 and the external wall 8 of the screen insert 5 (or the screen elements 9, respectively). The screen elements 9 are disposed so as to be substantially parallel with the main conveying direction F. However, in this embodiment screen elements 9 are also provided in the base region of the screen insert so that the screen insert 5 in the concept of the present invention is configured as a closed screen insert 5. However, these screen elements 9 account for only a very minor proportion of the entire screen area. In this embodiment, internal installations 12 which divert the flow to the screen elements are disposed on an axle 13. These internal installations 12 here are configured so as to be cone-shaped, wherein the diameter of the base areas of the internal cone-shaped installations 12 is larger the farther downstream the respective internal installation 12 is located. The screen elements (in this embodiment as well as overall within the scope of the invention) may be configured so as to be retrievable from the screen insert, for example by way of clips or screw connections (not shown). Both the housing inlet 3 as well as the housing outlet 4 are provided with hose couplings 10, for example firefighting couplings, such as Storz couplings. On account thereof, a fluid connection which is simple to handle and reliable is implementable.

FIG. 1*c* shows the device according to FIGS. 1*a/b* in a three-dimensional overall view. A flap or pivot cover 14 which, on the one hand, guarantees a reliable mounting of the screen insert 5 in the housing 2 and, on the other hand, also guarantees simple retrievability for cleaning purposes, for example, can be readily seen in this overall view. The design embodiment of the housing inlet 3 and of the housing outlet 4 using hose couplings (here Storz couplings) can be readily seen.

The screen insert 5 is separately illustrated in FIG. 1*d*. The screen elements 9 are disposed so as to be substantially entirely within the housing 2 (cf. FIG. 1*c*). A small proportion of the screen area is formed by a screen element 9 in the downstream end region of the screen insert 5.

The screen device 1 according to FIGS. 1*a-c*, having the screen insert 5 according to FIG. 1*d*, has a construction length of significantly less than 1 m; the region of the housing between the screw-fitted end pieces in which housing inlet 3 and housing outlet 4 are provided has a construction length of 50 cm, and an internal diameter of 20 cm. The internal diameter of the screen insert 5 in the region of the screen elements 9 is approx. 10 cm; a spatial region 6 which represents an annular space having an annular width of 5 cm is thus formed in this exemplary embodiment. A cone-shaped guide element which is directed with the cone tip upstream is provided in the downstream region of the housing in the transition to the end piece in which the housing outlet 4 is provided. The base area of the cone is approx. 15 cm wide so that an annular passage gap to the end piece, having an annular width of 2.5 cm, results. The device has a total screen area of approx. 150,000 $mm^2$.

FIGS. 2*a/b* show a second embodiment according to the invention of a screen device 1 in the cross section (FIG. 2*a*) and in a three-dimensional sectional drawing (FIG. 2*b*), respectively. The screen device 1 has a housing 2 which is configured so as to be substantially cylindrical. An axial housing inlet 3 is disposed in the upstream end region of the housing 2; a housing outlet 4 is disposed in the downstream end region of the housing 2. The housing 2 in this second embodiment has end pieces in which housing inlet 3 and housing outlet 4 are provided, wherein these end pieces are fitted by screw connections. Moreover, the screen device has a screen insert 5 which has screen elements 9. A spatial region 6 for the screen passage is formed between the internal wall 7 of the housing 2 and the external wall 8 of the screen insert 5 (or the screen elements 9, respectively). The screen elements are disposed so as to be substantially parallel with the main conveying direction F. Screen elements in the base region of the screen insert are not provided in the case of this second embodiment. An internal installation 12 which in the upstream direction is configured so as to be cone-shaped and extends substantially across the entire effective length of the screen insert 5 is disposed along an axle 13 in this embodiment. The cone-shaped internal installation 12 in the downstream end region of the screen insert reaches up to the screen elements. A likewise cone-shaped end region of the screen insert, which is directed with the cone tip downstream, is provided farther downstream. Moreover, external installations 11 which are configured so as to be helical throughout are provided in the spatial region 6 in this second embodiment. Both the housing inlet 3 as well as the housing outlet 4 are provided with hose couplings 10, for example firefighting couplings, such as Storz couplings.

FIG. 2*c* shows the device according to FIGS. 2*a/b* in a three-dimensional overall view. The flap or pivot cover 14 which, on the one hand, guarantees a reliable mounting of the screen insert 5 in the housing 2 and, on the other hand, also guarantees simple retrievability for cleaning purposes, for example, can be readily seen in this overall view. The design embodiment of the housing inlet 3 and of the housing outlet 4 using hose couplings (here Storz couplings) can be readily seen.

The screen insert 5 is separately illustrated in FIG. 2*d*. The screen elements 9 are disposed so as to be substantially on the entire effective external area of the screen insert within the housing 2 (cf. FIG. 2*c*). A cone which is directed downstream is present as a base region which does not have any screen elements 9 only in a downstream end region of the screen insert 5.

The screen device 1 according to FIGS. 2*a-c*, having the screen insert 5 according to FIG. 2*d*, has a construction length of significantly less than 1 m; the region of the housing between the screw-fitted end pieces in which housing inlet 3 and housing outlet 4 are provided has a construction length of 50 cm, and an internal diameter of 20 cm. The internal diameter of the screen insert 5 in the region of the screen elements 9 is approx. 10 cm; a spatial region 6 which represents an annular space having an annular width of 5 cm is thus formed in this exemplary embodiment. A cone-shaped guide element which is directed with the cone tip downstream is provided on the screen insert 5 in the downstream region of the housing in the transition to the end piece in which the housing outlet 4 is provided. The device has a total screen area of approx. 150,000 $mm^2$. The helical external installations 11 have a pitch height of 160 mm and extend across the entire annular width of 5 cm.

FIGS. 3*a/b* show a third embodiment according to the invention of a screen device 1 in the cross section (FIG. 3*a*) and in a three-dimensional sectional drawing (FIG. 3*b*), respectively. The screen device 1 has a housing 2 which is configured so as to be substantially cylindrical. An axial housing inlet 3 is disposed in the upstream end region of the housing 2; a housing outlet 4 is disposed in the downstream end region of the housing 2. The housing 2 in this third embodiment has end pieces in which housing inlet 3 and housing outlet 4 are provided, wherein these end pieces are fitted by screw connections. Moreover, the screen device has a screen insert 5 which has screen elements 9. A spatial region 6 for the screen passage is formed between the internal wall 7 of the housing 2 and the external wall 8 of the screen insert 5 (or the screen elements 9, respectively). The screen elements are disposed so as to be substantially parallel with the main conveying direction F. Screen elements in the base region of the screen insert are not provided in the case of this third embodiment. An internal installation 12 which is configured so as to be helical throughout is disposed along an axle 13 in this embodiment. In the downstream end region of the screen insert, a further internal installation, which is configured so as to be cone-shaped and directed with the cone tip upstream, in the region of the base area thereof reaches up to the screen elements. No external installations are provided in the spatial region 6 in this third embodiment. Both the housing inlet 3 as well as the housing outlet 4 are provided with hose couplings 10, for example firefighting couplings, such as Storz couplings.

FIG. 3*c* shows the device according to FIGS. 3*a/b* in a three-dimensional overall view. The flap or pivot cover 14 which, on the one hand, guarantees a reliable mounting of the screen insert 5 in the housing 2 and, on the other hand, also guarantees simple retrievability for cleaning purposes, for example, can be readily seen in this overall view. The design embodiment of the housing inlet 3 and of the housing outlet 4 using hose couplings (here Storz couplings) can be readily seen.

The screen insert 5 is separately illustrated in FIG. 3*d*. The screen elements 9 are disposed so as to be substantially on the entire effective external area of the screen insert within the housing 2 (cf. FIG. 3*c*). No screen elements are disposed in the base area, since in the downstream end region a cone-shaped internal installation by way of the base area thereof reaches up to the screen elements 9.

The screen device 1 according to FIGS. 3*a-c*, having the screen insert 5 according to FIG. 3*d*, has a construction length of significantly less than 1 m; the region of the housing between the screw-fitted end pieces in which housing inlet 3 and housing outlet 4 are provided has a construction length of 50 cm, and an internal diameter of 15 cm. The internal diameter of the screen insert 5 in the region of the screen elements 9 is approx. 10 cm; a spatial region 6 which represents an annular space having an annular width of 2.5 cm is thus formed in this exemplary embodiment. The device has a total screen area of approx. 157,000 $mm^2$. The helical internal installations 12 have a pitch height of 178.5 mm and extend along the axle 13 across substantially the entire internal width of the screen insert 5.

FIGS. 4*a/b* show a fourth embodiment according to the invention of a screen device 1 in the cross section (FIG. 4*a*) and in a three-dimensional sectional drawing (FIG. 4*b*), respectively. The screen device 1 has a housing 2 which is configured so as to substantially conically taper off in the downstream direction. An axial housing inlet 3 is disposed in the upstream end region of the housing 2; a housing outlet 4 is disposed in the downstream end region of the housing 2. The housing 2 in this fourth embodiment has end pieces in which housing inlet 3 and housing outlet 4 are provided, wherein these end pieces are fitted by screw connections. Moreover, the screen device has a screen insert 5 which has screen elements 9. A spatial region 6 for the screen passage is formed between the internal wall 7 of the housing 2 and the external wall 8 of the screen insert 5 (or the screen elements 9, respectively). The screen elements (or the external wall 8 of the screen insert, respectively) are disposed so as to be inclined toward the main conveying direction F at an angle of approx. 11° (but in the concept of the invention still so as to be substantially parallel with the main conveying direction F). Screen elements in the base region of the screen insert are also not provided in the case of this fourth embodiment. An internal member which substantially represents a truncated cone having a cover area which is aligned in the downstream direction is disposed along an imaginary longitudinal axis in this embodiment. A cone is configured so as to be directly contiguous to this truncated cone in the upstream end region, wherein the base areas of the truncated cone-shaped internal installation and of the cone have identical diameters. In the downstream end region of the screen insert, a further internal member, which again is configured so as to be truncated cone-shaped and by way of the cover area is directed upstream, in the region of the base area thereof reaches up to the screen elements; the cover area of this truncated cone is directly contiguous to the cover area of the truncated cone-shaped internal member. No external installations in the spatial region 6 are provided in this fourth embodiment. However, an internal installation 12 which helically encircles that truncated cone-shaped internal member that by way of the cover area thereof is directed downstream is provided. Both the housing inlet 3 as well as the housing outlet 4 are provided with hose couplings 10, for example firefighting couplings, such as Storz couplings.

FIG. 4*c* shows the device according to FIG. 4*a/b* in a three-dimensional overall view. The flap or pivot device 14 which, on the one hand, guarantees a reliable mounting of the screen insert 5 in the housing 2 and, on the other hand, also guarantees simple retrievability for cleaning purposes, for example, can be readily seen in this overall view. The design embodiment of the housing inlet 3 and of the housing outlet 4 using hose couplings (here Storz couplings) can be readily seen.

The screen insert 5 is separately illustrated in FIG. 4*d*. The screen elements 9 are disposed so as to be substantially on the entire effective external area of the screen insert within the housing 2 (cf. FIG. 3*c*). No screen elements are disposed in the base area, since in the downstream end region of the screen insert a truncated cone-shaped internal member by way of the base area thereof reaches up to the screen elements 9.

The screen device 1 according to FIGS. 4*a-c*, having the screen insert 5 according to FIG. 4*d*, has a construction length of significantly less than 1 m; the region of the housing between the screw-fitted end pieces in which housing inlet 3 and housing outlet 4 are provided has a construction length of 50 cm, and an internal diameter of between 23 cm in the upstream end region and 15 cm in the downstream end region. The internal diameter of the screen insert 5 in the region of the screen elements 9 is between approx. 20 cm in the upstream end region, and 10 cm in the downstream end region; a spatial region 6 which represents a substantially truncated cone-shaped annular space having an annular width of between 1.5 cm and 2.5 cm is thus formed in this exemplary embodiment. The device has a total screen area of approx. 215,000 $mm^2$.

The fifth screen device 1 according to the invention, illustrated in FIGS. 5*a* to 5*c*, has a cylindrical housing 2. Both an axial housing inlet 3 as well as a removable cover 14 are disposed in the upstream end region of the housing 2; a housing outlet 4 is disposed in the downstream end region of the housing 2. Moreover, the screen device 1 has a screen insert 5. A spatial region 6 for the screen passage is formed between the internal wall 7 of the housing 2 and an external wall 8 of the screen insert 5. Both the housing inlet 3 as well as the housing outlet 4 are provided with hose couplings 10 (not illustrated in detail here), for example firefighting couplings, such as Storz couplings. The housing 2 has four viewing windows 20 which are distributed on the circumference and through which the flour flowing through the screen insert 5 is visible. The screen device 1 according to FIGS. 5*a* to 5*c* has an internal housing wall diameter of 18.4 cm, and a construction length of 40 cm to 50 cm.

All exemplary embodiments described above are configured as passive screen devices. Said embodiments thus do not contain any actively driven components so that the former are of particularly low maintenance. Moreover, in all exemplary embodiments described above the flour is driven in a conveying flow of compressed air. The flour thus does not drop only by virtue of the force of gravity thereof, on account of which the throughput may be significantly increased.

The invention claimed is:

1. A passive foodstuff screen device for flour in a conveying flow, comprising:

a housing having a housing inlet and a housing outlet;

a closed screen insert disposed so as to be substantially within the housing in such a manner that:

i. a spatial region is formed between the internal wall of the housing and the external wall of the screen insert;

ii. one or more screen elements of the screen insert is/are disposed so as to be substantially parallel with the main conveying direction;

a hose coupling on the housing inlet and/or on the housing outlet, wherein the hose coupling is configured as a firefighting coupling;

wherein the foodstuff screen device is configured in such a manner that the flour is capable of being driven in a conveying flow of air through the one or more screen elements, whereby solid particulate matter may be removed from the flow of air and flour.

2. The screen device according to in claim 1, wherein the hose coupling is configured as a Storz coupling.

3. The screen device according to in claim 1, wherein said screen device has a weight of below 25 kg.

4. The screen device according to in claim 1, wherein said screen device has a construction length in the range from 5 cm to 1 m.

5. The screen device according to claim 1, wherein the internal wall of the housing has a diameter that is in the range from 11 cm to 35 cm.

6. The screen device according to claim 1, wherein the spatial region is configured so as to be one of substantially cylinder-barrel shaped, cone-shell shaped, or truncated cone-shell shaped.

7. The screen device according to claim 1, wherein external installations for flow direction are disposed in the spatial region.

8. The screen device according to claim 7, wherein external installations for flow direction are helically configured.

9. The screen device according to claim 1, wherein at least one internal installation for flow direction is disposed within the screen insert.

10. The screen device according to claim 9, wherein one internal installation or a plurality of internal installations is/are disposed in a substantially cone-shaped or truncated cone-shaped manner on an axle along the main conveying direction, and shell surface(s) of the internal installation(s) is/are aligned in the main conveying direction in such a manner that said shell surface(s) causes/cause deflection in the direction of the one or more the screen elements.

11. The screen device according to claim 1, wherein the housing has a lockable cover which enables the housing to be opened in such a manner that the screen insert is retrievable from the housing.

12. The screen device according to claim 11, wherein the lockable cover is arranged in a region of the housing inlet.

13. The screen device according to claim 11, wherein the lockable cover is a removable cover or a flap or a pivot cover.

14. The screen device according to claim 1, wherein the housing inlet is disposed in a tangential manner.

15. The screen device according to claim 1, wherein the housing has at least one viewing window through which the flour flowing through the screen insert is visible.

16. A method of using a foodstuff screen device according to claim 1 as a screen device which is capable of being conjointly carried on a silo vehicle, comprising the step of pneumatically conveying flour through the screen device.

17. The foodstuff screen device according to claim 1, wherein the foodstuff screen device is installed on a silo vehicle.

18. A method for unloading a silo vehicle, the method comprising the following steps:

establishing a fluid connection between an outlet of the silo vehicle and an inlet of a silo in such a manner that the fluid connection comprises a foodstuff screen device as claimed in claim 1; and pneumatically conveying a payload from the silo vehicle through the screen device into the silo.

19. The method according to claim 18, wherein the foodstuff screen device is retrieved from a stowage compartment of the silo vehicle and incorporated into the fluid connection.

* * * * *